US005580228A

United States Patent [19]

Ishikawa et al.

[11] Patent Number: 5,580,228

[45] Date of Patent: Dec. 3, 1996

[54] SCROLL COMPRESSOR HAVING GROOVES FOR SEAL MEMBERS

[75] Inventors: Kimihiro Ishikawa, Aichi; Takashi Miyakawa, Kariya; Yasushi Watanabe, Kariya; Tetsuhiko Fukanuma, Kariya; Shinya Yamamoto, Kariya, all of Japan

[73] Assignees: Nippondenso Co., Ltd.; Kabushiki Kaisha Toyoda Jidoshokki Seisakucho, both of Kariya, Japan

[21] Appl. No.: 363,775

[22] Filed: Dec. 27, 1994

[30] Foreign Application Priority Data

Dec. 27, 1993 [JP] Japan ..... 5-332525

[51] Int. Cl.[6] ..... F04C 18/04; F04C 27/00

[52] U.S. Cl. ..... 418/55.2; 418/55.4; 418/142; 29/888.022

[58] Field of Search ..... 418/55.2, 55.4, 418/142; 29/888.022

[56] References Cited

U.S. PATENT DOCUMENTS 5,364,247 11/1994 Fukanuma et al. ..... 418/55.4

5,427,513 6/1995 Yamada et al. ..... 418/55.4

FOREIGN PATENT DOCUMENTS 1-30637 9/1989 Japan .

*Primary Examiner*—John J. Vrablik

*Attorney, Agent, or Firm*—Cushman, Darby & Cushman

[57] ABSTRACT

A scroll member has a scroll wall having an axial end having a transverse surface on which a groove 20 is cut along the spiral direction of the scroll wall, to which groove a seal member contacting a facing scroll member is received. The scroll wall having a radially inner portion of having a width larger than the width of remaining part of the scroll wall. At the radially inner portion, the groove is also widened. When molding the scroll member, a recess deeper than the depth of the groove to be machined is created. The groove is obtained by machining the scroll member as molded by a milling tool. The widened portion of the groove is formed by moving a milling tool along a closed trajectory, so that the recess is left un-machined.

4 Claims, 10 Drawing Sheets

SCROLL COMPRESSOR HAVING GROOVES FOR SEAL MEMBERS

BACKGROUND OF THE INVENTION

1. Field of the Invention

The present invention relates to a scroll compressor, and more particularly, to a scroll compressor having a groove for receiving a seal member of a scroll shape.

2. Description of Related Art

Prior art scroll compressors include a stationary scroll member having a scroll wall and a movable scroll member having a scroll wall, which is arranged in a side-by-side contact relationship with respect to the scroll wall of the stationary scroll member, thus defining closed chambers between the stationary and movable scroll members. A mechanism is provided for preventing self rotation of the movable scroll member, while allowing orbital movement of the movable scroll member about an axis of a drive shaft, so that the closed chambers move radially inwardly while their volumes are reducing. Furthermore, the end of the scroll wall of each of the stationary and movable scroll members has a thickness larger than the remaining part of the scroll wall, and is formed with a recess for receiving a scroll shaped seal member, which is in sealing contact with a facing surface of the base plate of the opposite scroll member. During the operation of the scroll compressor, the closed chambers are moved radially toward inner ends of the scroll walls of the stationary and movable scroll members, so that compressed refrigerant gas is discharged to an outlet port.

High pressure of the refrigerant gas in the chambers during the compression subjects the inner ends of the scroll walls of the stationary and movable scroll members to higher temperature and a higher pressure of the refrigerant gas in comparison with the other parts of the scroll walls. The scroll walls are made integral with respect to the base plates in order to increase the strength and the rigidity of the scroll walls. However, the scroll walls are cut out at the inner ends of the scroll walls, causing the strength as well as the rigidity to be reduced. In other words, the scroll walls are apt to be damaged at the inner ends when subjected to the high temperature and the high pressure of the refrigerant gas.

Japanese Examined Patent Publication No. 1-30637 discloses a scroll compressor, wherein an inner end of the scroll wall has an increased width, thereby increasing its strength and rigidity. The width of the groove for receiving the seal member on the end surface of the scroll wall is also increased at the location corresponding to the inner end of the scroll wall.

The scroll member is made from a molding, such as a die-casting. The groove is machined using a machine tool, in the molded surface of the scroll member. Specifically, an end mill with a machine tool of a diameter corresponding to the width of the groove is introduced onto the molded surface. At the inner end of the scroll wall, the width is increased to a value more than twice the width of the wall at the outer end, so that a single pass of the machine tool is insufficient to obtain a desired width of the groove, which is more than twice the width of the groove at the outer end. Thus, a reciprocal movement of the machine tool is necessary at the inner end of the scroll wall to machine the grooves. As a result, the labor required to complete the machining is increased.

SUMMARY OF THE INVENTION

An object of the present invention is to provide a scroll compressor having a machined groove for a seal member on a molded scroll member that is less labor-intensive to produce than prior art compressors.

According to the first aspect of the present invention, a scroll compressor is provided, comprising:

a housing;

a drive shaft rotatably supported on the housing;

a stationary scroll member which is stationary in relation to the housing, the stationary scroll member having a base portion and a scroll wall extending axially from the base portion and having an axial end spaced therefrom;

a movable scroll member which is rotatably supported on the housing so that it is eccentric with respect to the stationary scroll member, the movable scroll member having a base portion and a scroll wall extending axially from the latter base portion;

the scroll walls of the stationary and movable scroll members being in side-by-side contact with each other, while the scroll walls axially contact with facing base plates, so that radially spaced pump chambers are created between the stationary and movable scroll members;

the drive shaft being in connection with the movable scroll member so that an orbital movement of the movable scroll member is obtained about an axis of the shaft, so that the pump chambers are moved radially, while reducing their volumes;

an inlet port for introducing a fluid to be compressed into the pump chamber when it is located radially outwardly;

an outlet port for discharging the fluid as compressed from the pump chamber when it is located radially inwardly;

the scroll walls of the stationary and movable scroll members defining, at respective ends facing the opposite base plates, machined grooves extending along the direction of the spiral of the scroll members, the groove defining facing surfaces in parallel to the axis of the shaft;

seal members fitted to the grooves of the stationary and movable scroll members, respectively;

the scroll walls having, at their radially inner part, an increased width when compared with the remaining parts of the scroll walls;

at the radially inner part of each of the scroll walls of the larger width, the spacing between the opposite surfaces of the groove being increased when compared with the other part of the groove, while leaving, between the opposite surfaces, a portion not subjected to the machining when creating the groove.

According to the second aspect of the present invention, a scroll compressor is provided, comprising:

a housing;

a drive shaft rotatably supported on the housing;

a stationary scroll member which is stationary in relation to the housing, the stationary scroll member having a base portion and a scroll wall extending axially from the base portion and having free end spaced therefrom;

a movable scroll member which is rotatably supported on the housing so that it is eccentric with respect to the stationary scroll member, the movable scroll member having a base portion and a scroll wall extending axially from the latter base portion;

the stationary and movable scroll members being made by molding;

the scroll walls of the stationary and movable scroll members being in side-by-side contact with each other, while the scroll walls axially contact facing base plates, so that radially spaced pump chambers are created between the stationary and movable scroll members;

the drive shaft being in connection with the movable scroll member so that an orbital movement of the movable scroll member is obtained about an axis of the shaft, so that the pump chambers are moved radially, while reducing their volumes;

an inlet port for introducing a fluid to be compressed into the pump chamber when it is located radially outwardly;

an outlet port for discharging the fluid as compressed from the pump chamber when it is located radially inwardly;

each of the scroll walls of the stationary and movable scroll members defining, at the end facing the opposite base plate, a machined groove extending along the direction of the spiral of the scroll members, the groove defining facing surfaces in parallel to the axis of the shaft;

seal members fitted to the grooves of the stationary and movable scroll members, respectively;

the scroll walls having, at their radially inner part, an increased width when compared with the remaining parts of the scroll walls;

at the inner radial part of each of the scroll walls of the larger width, the spacing between the opposite surfaces of the groove being increased when compared with the other part of the groove, while leaving, between the opposite surfaces, a portion having an outer surface obtained at the molding.

According to the third aspect of the present invention, a scroll compressor is provided, comprising:

a housing;

a drive shaft rotatably supported on the housing;

a stationary scroll member which is stationary in relation to the housing, the stationary scroll member having a base portion and a scroll wall extending axially from the base portion and having an axial end spaced therefrom;

a movable scroll member which is rotatably supported on the housing so that it is eccentric with respect to the stationary scroll member, the movable scroll member having a base portion and a scroll wall extending axially from the latter base portion;

the scroll walls of the stationary and movable scroll members being in side-by-side contact with each other, while the scroll walls axially contact facing base plates, so that radially spaced pump chambers are created between the stationary and movable scroll members;

the drive shaft being in connection with the movable scroll member so that an orbital movement of the movable scroll member is obtained about an axis of the shaft, so that the pump chambers are moved radially, while reducing their volumes;

an inlet port for introducing a fluid to be compressed into the pump chamber when it is located radially outwardly;

an outlet port for discharging the fluid as compressed from the pump chamber when it is located radially inwardly;

each of the scroll walls of the stationary and movable scroll members defining, at the respective end facing the opposite base plate, a groove extending along the direction of the spiral of the scroll members, the groove defining faced surfaces in parallel to the axis of the shaft;

seal members fitted to the grooves of the stationary and movable scroll members, respectively;

the scroll walls having, at their radially inner parts, an increased width when compared with the remaining parts of the scroll walls;

at the radially inner part of each of the scroll walls of the larger width, the spacing between the opposite surfaces being increased when compared with the other part of the groove, the groove having a recess spaced from the inner surfaces in the direction of the width of the groove, the groove having a depth at the location of the recess larger than the remaining location of the groove.

According to the fourth aspect of the present invention, a scroll compressor is provided, comprising:

a housing;

a drive shaft rotatably supported on the housing;

a stationary scroll member which is stationary in relation to the housing, the stationary scroll member having a base portion and a scroll wall extending axially from the base portion and having an axial end spaced therefrom;

a movable scroll member which rotatably supported on the housing so that it is eccentric with respect to the stationary scroll member, the movable scroll member having a base portion and a scroll wall extending axially from the latter base portion;

the scroll walls of the stationary and movable scroll members being in side-by-side contact with each other, while the scroll walls axially contact facing base plates, so that radially spaced pump chambers are created between the stationary and movable scroll members;

the drive shaft being in connection with the movable scroll member so that an orbital movement of the movable scroll member is obtained about an axis of the shaft, so that the pump chambers are moved radially, while reducing their volumes;

an inlet port for introducing a fluid to be compressed into the pump chamber when it is located radially outwardly;

an outlet port for discharging the fluid as compressed from the pump chamber when it is located radially inwardly;

each of the scroll walls of the stationary and movable scroll members defining, at the respective end facing the opposite base plate, a groove extending along the direction of the spiral of the scroll members, the groove defining faced surfaces in parallel to the axis of the shaft;

seal members fitted to the grooves of the stationary and movable scroll members, respectively;

the scroll walls having, at their radially inner parts, an increased width when compared with the remaining parts of the scroll walls;

at the radially inner part of each of the scroll walls of the larger value, the spacing between said opposite surfaces being increased when compared with the other part of the scroll wall, the groove having a projection spaced from the inner surfaces in the direction of the width of the groove, the groove having a depth at the location of the projection smaller than the remaining location of the groove.

BRIEF EXPLANATION OF ATTACHED DRAWINGS

DETAILED DESCRIPTION OF PREFERRED EMBODIMENTS

Figure 1:
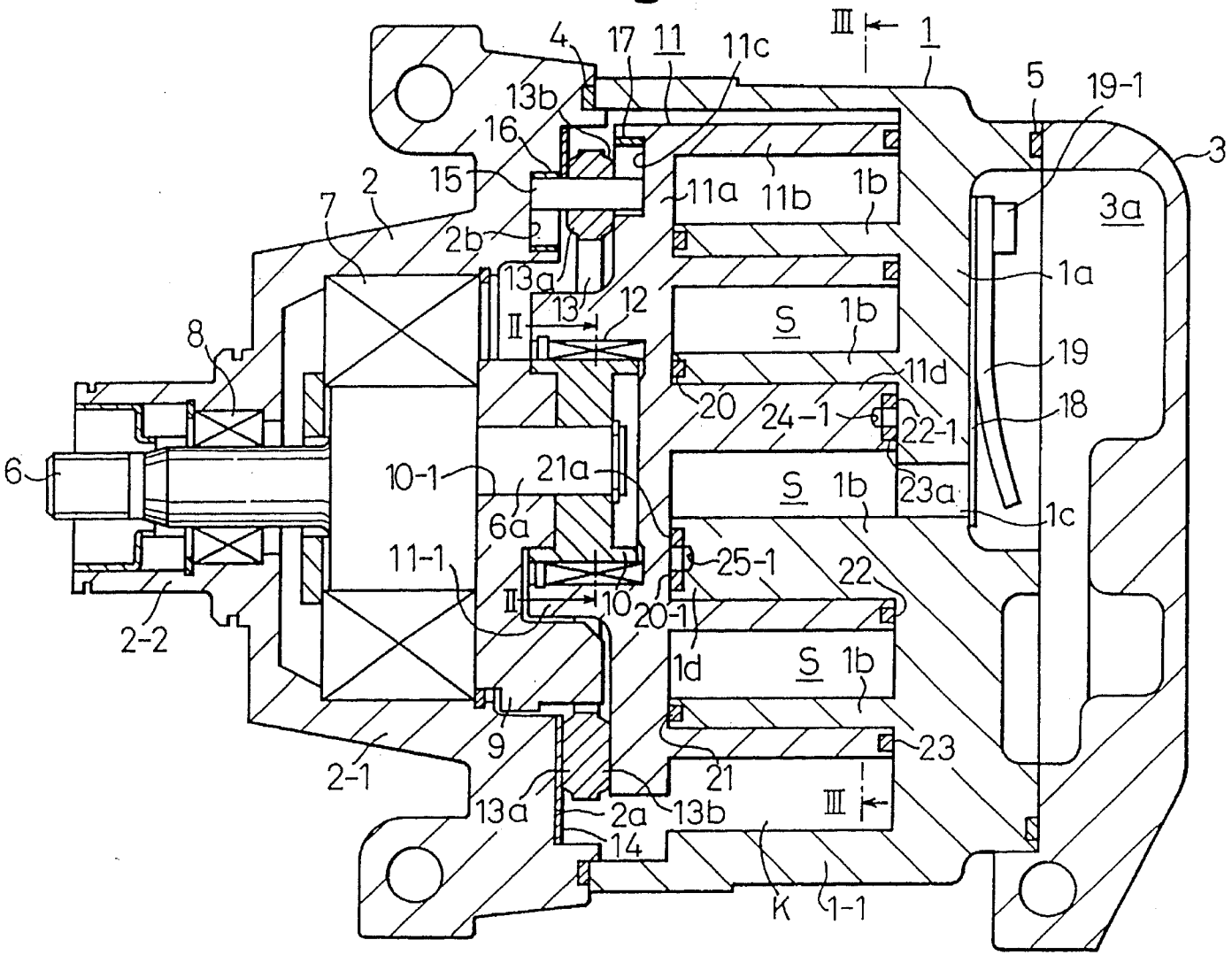
FIG. 1 is a longitudinal cross-sectional view of a scroll compressor according to the present invention.

A first embodiment of the present invention will be explained with reference to FIGS. 1 to 3. In FIG. 1, reference numeral 1 denotes a stationary scroll member which functions also as a housing preferably made of an aluminum based alloy. Connected to the stationary scroll member 1 by suitable means, such as bolts and nuts, are front and rear housings 2 and 3 respectively, also preferably made of an aluminum based alloy. A seal ring 4 is arranged between facing surfaces of the stationary scroll member 1 and a front housing 2, and a seal ring 5 is arranged between faced surfaces of the stationary scroll member 1 and a rear housing 3. The front housing 2 has an outer boss portion 2-1, in which a bearing unit 7 is stored for rotatably supporting a rotating shaft 6 with respect to the front housing 2. The front housing 2 further has an inner boss portion 2-2, in which a shaft seal unit 8 is stored at a location adjacent to and axially outwardly from the bearing unit 7, thereby preventing a lubricant for lubricating parts in the compressor from being leaked.

Figure 2:
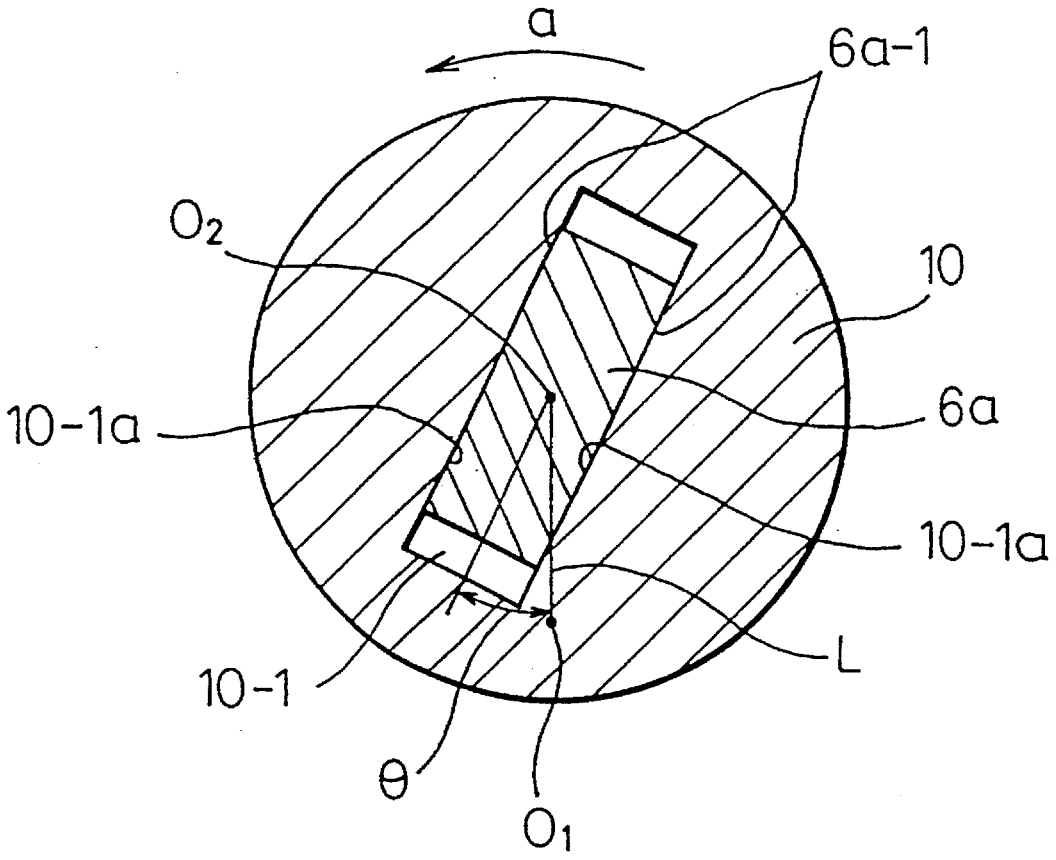
FIG. 2 is a cross-sectional view taken along line II—II in FIG. 1.

The drive shaft 6 is, at its inner end, integrally formed with a drive key 6*a*, which is eccentric with respect to an axis $O_1$ of the drive shaft 6 (see FIG. 2). Reference numeral 10 denotes a bushing having a driven groove 10-1, to which the drive key 6*a* of the drive shaft engages. As shown in FIG. 2, the drive key 6*a* is formed with a pair of surfaces 6*a*-1, disposed inspaced, parallel ralation, and which engage with facing surfaces 10-1*a* of the groove 10-1. Furthermore, these surfaces are, in the transverse cross section, inclined at an angle θ with respect to the line L connecting the axis $O_1$ of the shaft 6 and the axis $O_2$ of the bushing 10 in the direction opposite the rotation of the shaft as shown by an arrow a. As a result, a so-called follower crank mechanism is constructed. A balance weight 9 is connected integrally with respect to the bushing 10, so that it is located opposite the bushing 10, thereby balancing the centrifugal force generated during the orbital movement of the bushing 10.

A reference numeral 11 designates a movable scroll member having a boss portion 11-1, which is rotatably supported by the bushing 10 by means of a bearing unit 12. The movable scroll member 11 is further formed with a base plate 11*a* and a scroll wall 11*b* axially extending from the base plate 11*a*. Similarly, the stationary scroll member 1 is formed with a base plate 1*a* and a scroll wall 1*b*. The scroll wall 11*b* of the movable scroll member 11 is in a side-by-side contact relationship with the scroll wall 1*b* of the stationary scroll member 1, so that pump chambers S are created between the scroll wall 1*b* and 11*b*, and the base plates 1*a* and 11*a*. The chamber K, which is at a radially outermost position, is referred to as an intake chamber and is created between the outer scroll wall of the movable scroll member 11 and the cylindrical wall portion 1-1 of the stationary scroll member 1. This chamber K is opened to an inlet port 1*k* (see FIG. 3) connected to a source of the gaseous refrigerant to be compressed. Due to the eccentric arrangement of the drive key 6*a* with respect to the shaft 6, the movable scroll member 11, which is rotatably supported on the bushing 10 engaging the drive key 6*a*, is also eccentric with respect to the axis of the shaft 6. As a result, a rotational movement of the shaft 6 causes an orbital movement of the movable scroll member 11. During the orbital movement of the movable scroll member 11, the intake chamber K initially formed is disconnected from the intake port so as to form a closed chamber, such as the one shown by S, which moves radially inwardly toward the inner ends of the scroll walls 1*b* and 11*b* while its volume reduces to cause compression. In the innermost position of the chamber, the chamber is opened to an outlet port 1*c* formed at the center of the base plate 1*a* of the stationary scroll member 1 so the compressed refrigerant is discharged into the outlet port 1*c*.

As shown in FIG. 1, a rotation blocking ring 13 is arranged between the base plate 11*a* of the movable scroll member 11 and an anti-abrasion metal plate 14 fixed to a pressure receiving wall 2*a* of the front housing 2. The rotation blocking ring 13 is provided with equiangularly spaced opposite pairs (more than three pairs) of force receiving projections 13*a* and 13*b*, which are in face-to-face contact with opposite surfaces of the metal plate 14 and the base plate 11*a* of the movable scroll member 11, respectively. The surface of the base plate 11*a* contacting the force receiving projections 13*b* is formed with a plating of nickel-boron for anti-abrasion purposes. The opposite pairs of pressure receiving projections 13*a* and 13*b* are formed with axial bores therethrough, to which self-rotation blocking pins 15 are rotatably inserted so that they are projected out of the projections 13*a* and 13*b*, respectively. The front housing 2 is formed with self-rotation blocking recesses 2*b* of the same number as that of the pins 15 for receiving the ends of the pins 15 projecting from the projections 13*a*. Similarly, the base plate 11*a* of the movable scroll member 11 is formed with equiangularly spaced self-rotation blocking recesses 11*c* of the same number as that of the pins 15 for receiving the ends of the pins 15 projecting from the projections 13*b*. Anti-abrasion sleeves 16 and 17 made of steel material are fitted to the self-rotation blocking recesses 2*b* and 11*c*, respectively. It should be noted that the insertion of the self-rotation blocking pins 15 into the self-rotation blocking recesses 2*b* and 11*c* is done such that the pins 15 are slightly spaced from bottom surfaces of the recesses 2*b* and 11*c*.

An outlet chamber 3*a* is created between the base plate 1*a* of the stationary scroll member 1 and the rear housing 3. An outlet valve unit is arranged in the chamber 3*a*, which is constructed by an outlet valve 18 as a reed valve, a stopper 19 for preventing the outlet valve 18 from being buckled, and a screw 19-1 for fixing the valve 18 as well as the stopper 19 to the base plate 1*a*. The outlet valve 18 (reed valve) is formed from an elastic plate member, the resiliency of which generates a force for normally closing the port 1*c*. The pressure of the compressed gas allows the valve 18 to be deflected against the force of the resilient force to open the outlet port 1*c*.

The rotating movement of the shaft 6 causes the movable scroll member 11 to effect an orbital movement about the axis $O_1$ of the shaft 6, so that the refrigerant gas from an inlet port is introduced into the intake chamber K formed between the stationary and movable scroll members 1 and 11, located at the radially outermost positions. Then, the chambers are, as shown by S, moved radially inwardly, so that they are sealingly closed, while the volume is reduced, thereby compressing the gaseous refrigerant therein. In the chamber S, which is located at the inner ends of the scroll walls 1*b* and 11*b* of the stationary and movable scroll members, the chamber is opened to the outlet port 1*c*, causing the delivery valve 18 to be opened, so that the compressed gas is discharged into the outlet chamber 3*a*. In this case, the stopper 19 prevents the delivery valve 18 from being opened excessively.

During the operation of compressing the gas in the closed chambers S, a compression reaction force is generated in the movable scroll member 11, which is transmitted, from the movable scroll member 11, via the pressure receiving projections 13*b* and 13*a*, and the plate 14, to the pressure receiving wall 2*a*.

The orbital movement of the movable scroll member 11 causes the self-rotation blocking pins 15 to rotate about the respectively axis centered to the respective stationary recess 2*b*, while the pins 15 are held between opposite portions of the inner surfaces of the sleeves 16 and 17, so that the rotation blocking ring 13 is urged radially outwardly, i.e., in the direction from the axis of the orbital movement of the movable scroll member to the axis of the movable scroll member located on the trajectory of the orbital movement. The radius r of the orbital movement of the bushing 10 is equal to D–d , where D is the inner diameter of the sleeves 16 and 17, and d is an outer diameter of the self-rotation blocking pin 15. Thus, the relationship between the inner diameter D of the sleeves 16 and 17, the outer diameter d of the self-rotation blocking pin 15, and the radius of the orbital movement of the bushing 10, i.e., the radius r of the orbital movement of the movable scroll member 11, is defined by the equation $$D=d+r$$

The radius r of the orbital movement of the movable scroll member is determined by this relationship. A radius of the orbital movement of the self-rotation blocking pins 15 becomes one half of the radius r of the orbital movement of the movable scroll member 11.

The ring 13, as well as the movable scroll member 11, is urged to be rotated about its own axis. An arrangement of the equiangularly spaced self-rotation blocking pins held between the facing portions of the inner surfaces of the sleeves 16 and 17 fitted to respective opposite pairs of the recesses 2*b* and 11*c* can prevent the ring 13 as well as the movable scroll member from being rotated about its own axis. More than three blocking pins is preferred.

Figure 3:
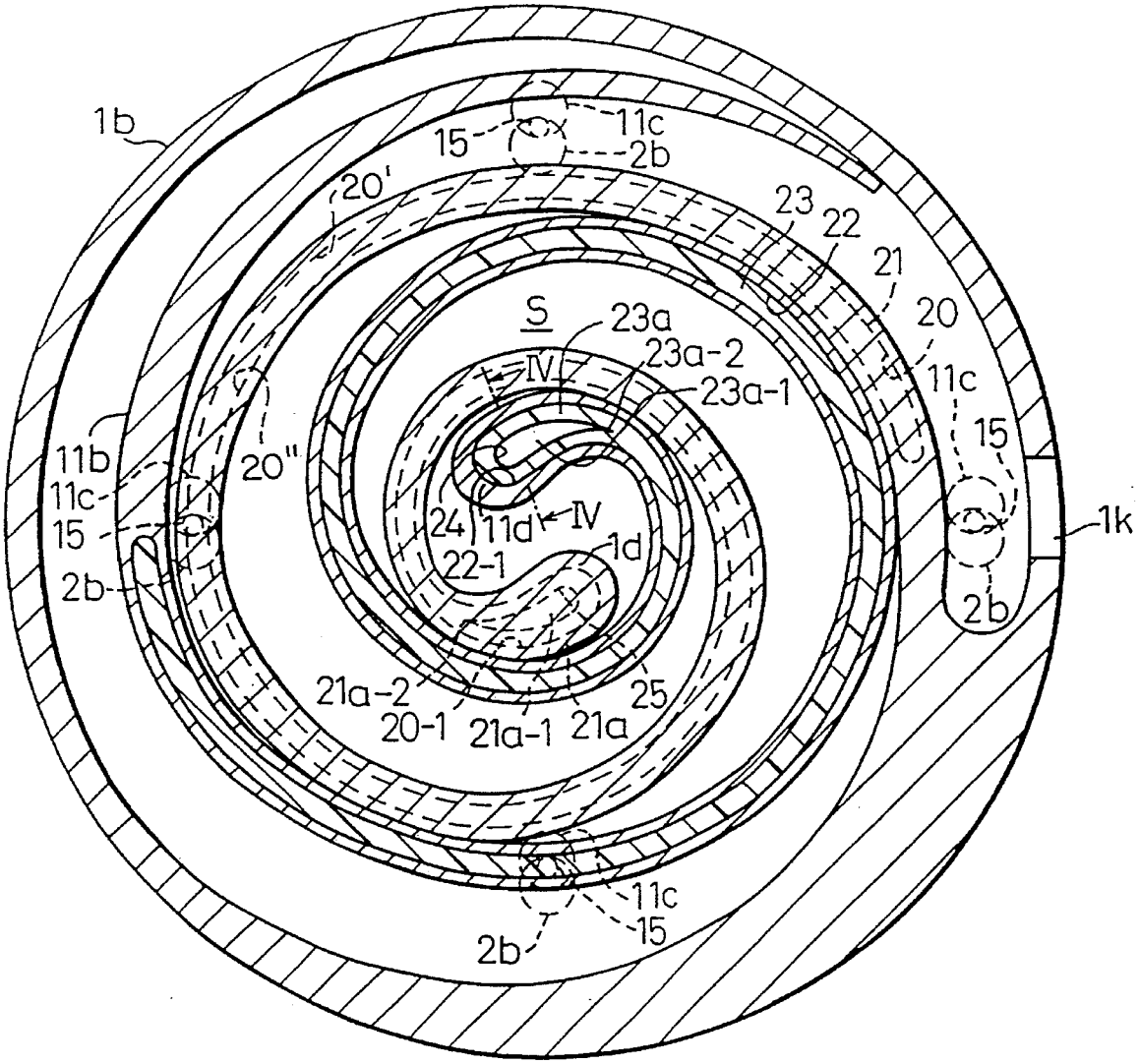
FIG. 3 is a cross-sectional view taken along line III—III in FIG. 1.

As shown in FIGS. 1 and 3, the end of the scroll wall 1*b* of the stationary scroll member 1, which faces the surface of the base plate 11*a* of the movable scroll member 11, has a groove 20 which extends along the scroll shape of the scroll wall 1*b*. The groove 20 has opposite surfaces 20' and 20" which are radially spaced in parallel. A seal member 21 made of plastic resin is fitted to the scroll groove 20, so that the seal member 21 contacts the facing surface of the base plate 11*a*. Similarly, the end of the scroll wall 11*b* of the movable scroll member 11, which faces the surface of the base plate 1*a* of the stationary scroll member 1 has a groove 22 which extends along the scroll shape of the scroll wall 11*b*. A seal member 23 made of a plastic resin is fitted to the scroll groove 22, so that the seal member 23 contacts the facing surface of the base plate 1*a*. These seal members 21 and 23 maintain their contact with the respective facing surfaces, thereby obtaining a highly sealed structure of the pump chambers S.

Figure 4:
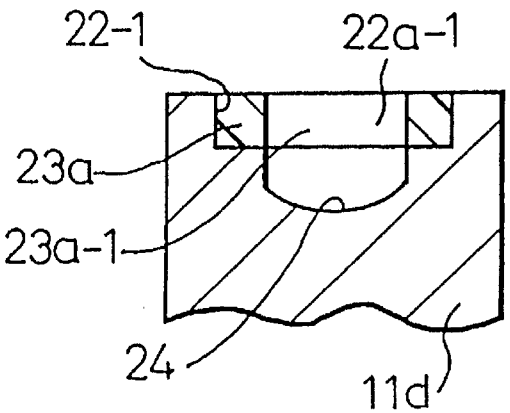
FIG. 4 is a cross-sectional view taken along line IV—IV in FIG. 3 before a groove is machined.

As shown in FIG. 3, the scroll walls 1*b* and 11*b* have radially inner portions 1*d* and 11*d*, respectively, having a thickness larger than the remaining portions of the scroll walls. Typically, the thickness of the inner portions 1*d* and 11*d* is larger than twice the thickness of the outer ends of the scroll walls. As a result, the scroll member have increased strength at the inner ends which are subjected to a higher pressure. The increased thickness is also effective for reducing the volume of the pump chamber to zero at the final stage of the compression, thereby enhancing the volumetric efficiency. The grooves 20 and 22 for storing the seal members 21 and 23, respectively, have inner ends 20-1 and 22-1, respectively, of an increased width at the inner portions 1*d* and 11*d* of the scroll walls 1*b* and 11*b*. Usually, the width of the inner ends 20-1 and 22-1 of the grooves 20 and 22 is larger than twice the width of the outer ends of the respective grooves. As shown in FIG. 4, at the inner portion 11*d* of the movable scroll member 11, a recess 24 of an increased depth when compared with the depth at the remaining parts of the groove 22 is created at the bottom of the groove 22. As shown in FIG. 3, the inner end of the seal member 23 has an annular portion 23*a*, which defines, as shown in FIG. 4, an opening 23*a*-1. The opening 23*a*-1 has an inner circumference which is co-planner with respect to an inner circumference of the recess 24 at the inner end of the groove 22 for receiving the seal member 23. Similarly, at the inner portion 1*d* of the stationary scroll member 1, a recess 25 of an increased depth when compared with the depth at the remaining parts of the groove 20 is created. As shown in FIG. 3, the inner end of the seal member 21 has an annular portion 21*a*, which defines an opening 21*a*-1. The opening 21*a*-1 has an inner circumference which is co-planner with respect to an inner circumference of the deepened portion 25 at the inner end of the groove 20 for receiving the seal member 21.

Figure 7:
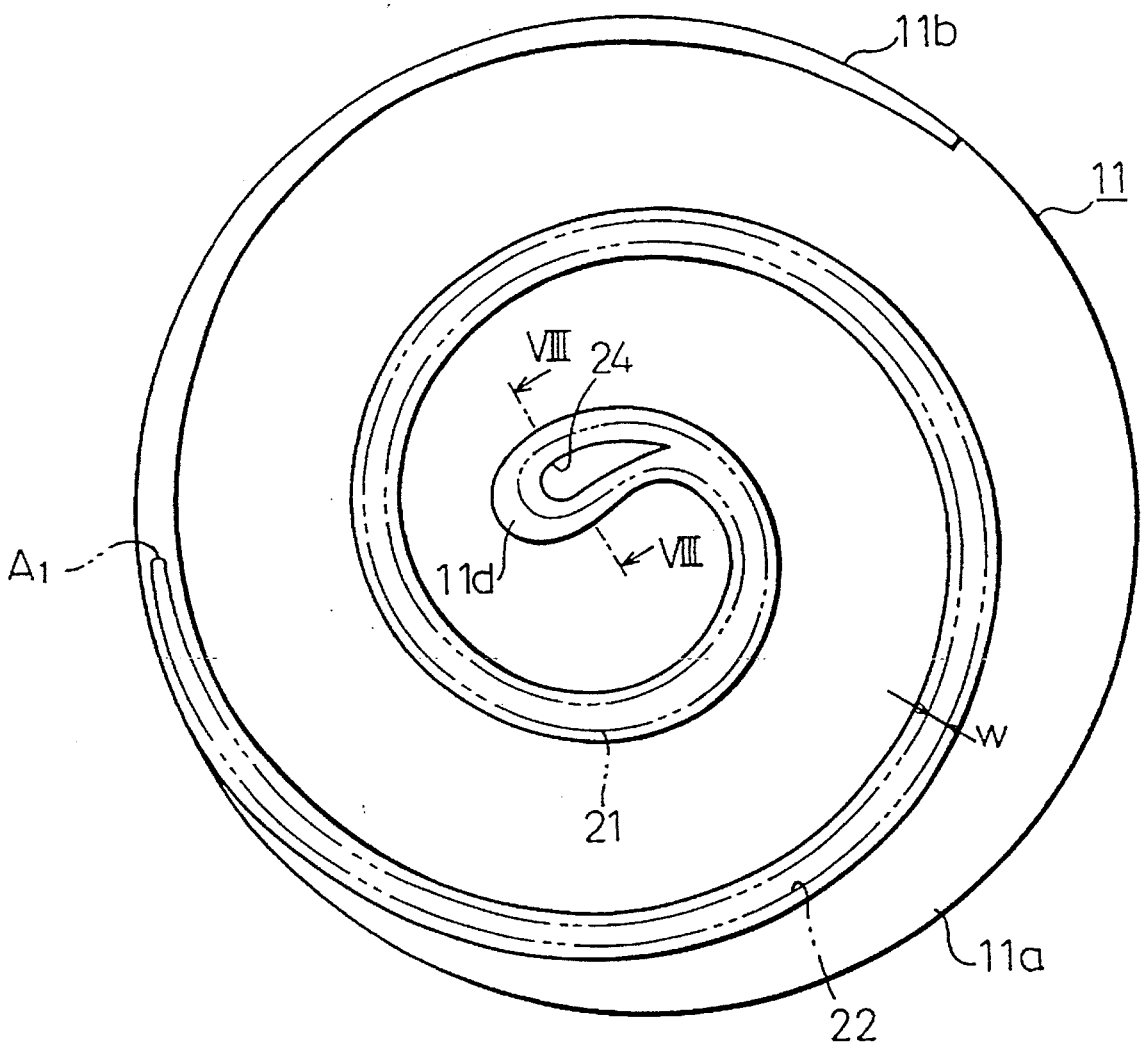
FIG. 7 is a plan view of a movable scroll member in the scroll compressor in FIG. 1 before it is machined.
Figure 8:
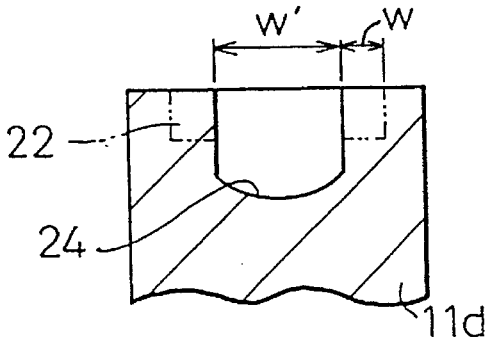
FIG. 8 is a cross-sectional view taken along line VIII—VIII in FIG. 7 before a groove is machined.

The movable scroll member 1*b* and stationary scroll member 11*b* are molded from aluminum alloy by a die-casting or forging. FIG. 7 shows the movable scroll member 11 just after being molded. As shown in FIG. 8, the deepened portion 24 at the inner portion 11*d* of the scroll wall 11*b* of the movable scroll member 11 is obtained by molding. The material to be machined using an end mill is shown by the phantom lines in FIGS. 7 and 8. Namely, on the axial end surface of the scroll wall, machining of the area of W is commenced from a point $A_1$ by axially introducing an end mill having a diameter which is the same as the width W of the groove 22 and by moving the tool along the axial end surface of the scroll portion. At the inner widened portion 11*d* of the scroll member 11, a single movement of the tool along a closed trajectory, which conforms to the close profile of the recess 24, is done. Such a single looped movement of the tool is sufficient to create an inner end of the groove 22 of a width larger than twice the width of the groove at the outer end, due to the fact the deepened portion 24 of a width W' makes the width w machined to be smaller than the diameter of the tool. As a result, an increased productivity in machining can be obtained. After the machining of the groove 22 on the end surface of the scroll wall 11*d* of the movable scroll member 11, the seal member 23 is fitted as shown in FIG. 5, so that the seal member 23 closes the deepened portion 24, thereby preventing the portion from being opened outwardly.

A machining of the groove 20 on the scroll wall 1*d* of the stationary scroll member 1 is similarly done as that for the groove 22 on the movable scroll member, as explained above.

Figure 5:
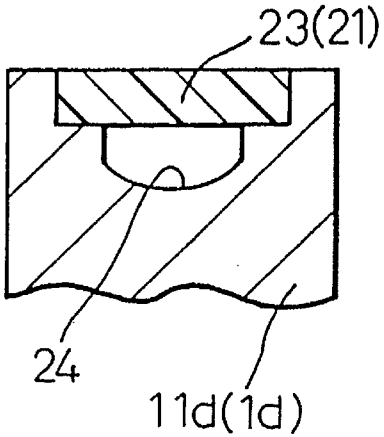
FIG. 5 is the same as FIG. 4 but a groove is machined and a seal member is fitted.
Figure 6:
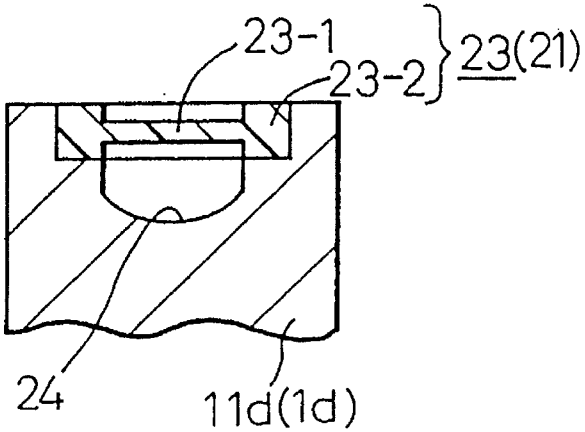
FIG. 6 is similar to FIG. 5 but illustrates a modification.

In FIG. 5, at the inner portion 11*d* or 1*d* of the scroll wall 11*b* or 1*b*, the seal member 23 or 21 has a constant thickness. This arrangement is desirable for obtaining an increased strength of the seal member 23. In a modification shown in FIG. 6, the seal member 23 or 21 is at the inner end constructed by a central portion 23-1 and outer portions 23-2, and the thickness of the central portion 23-1 is reduced with respect to the thickness of the outer portions 23-2. When the seal member 23 or 21 made of a molding of a synthetic resin has the cross-sectional shape as shown in FIG. 5, a phenomenon is apt to be generated that a shrinkage of thickness occurs at the central portion. Such a shrinkage is not desirable since the precision of the thickness of the seal member 23 or 21 is reduced. The provision of the central portion 23-1 of the reduced thickness as shown in FIG. 6 can prevent the shrinkage of the seal member 23 or 21 from occurring. It should be noted that the thick outer portions 23-2 can maintain substantially the same level of the strength of the seal member 23 or 21 when compared with the construction in FIG. 5.

Figure 9:
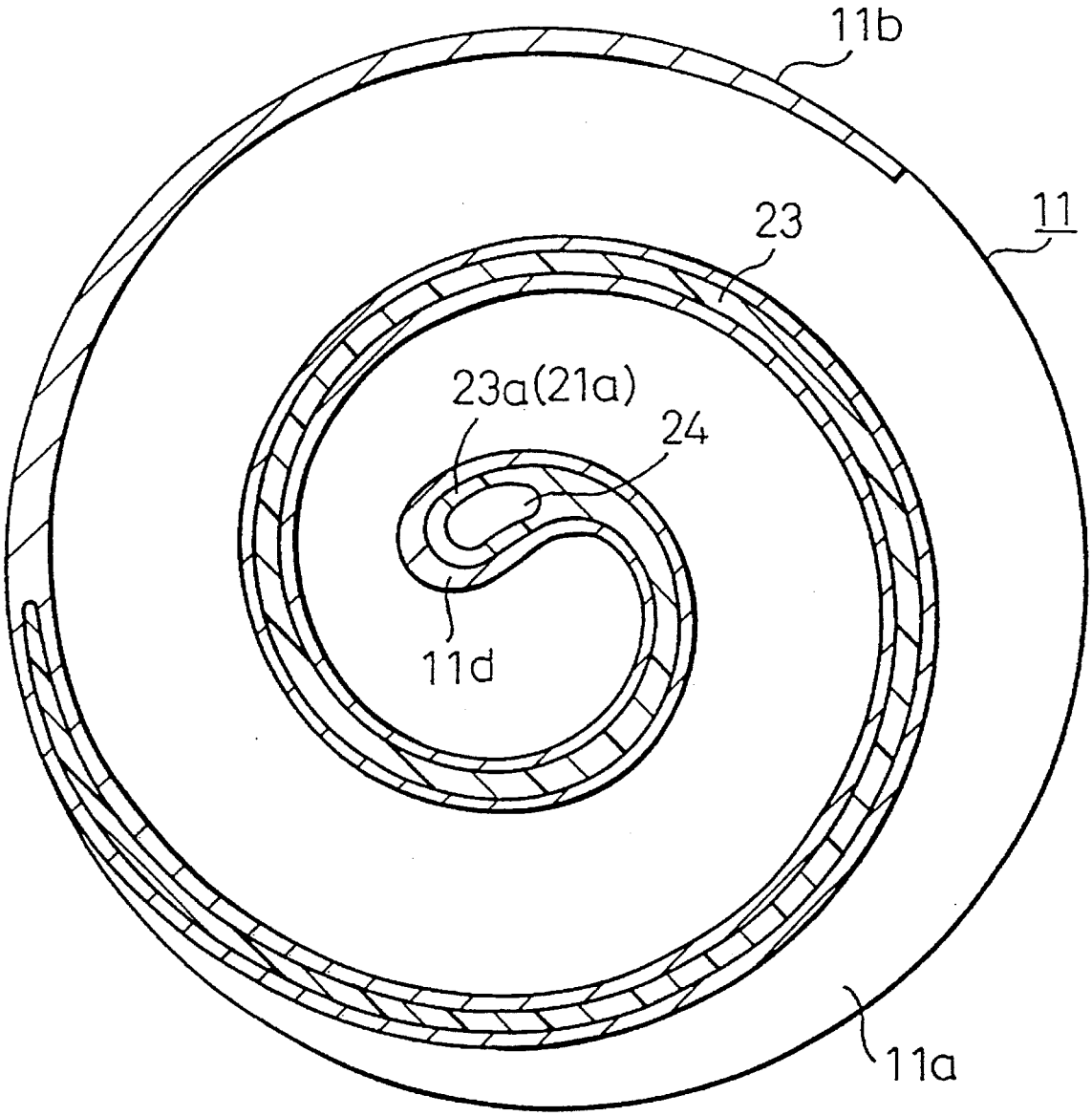
FIG. 9 is similar to FIG. 7 but illustrates a modification.

FIG. 9 is a modification of the shape of the closed profile of the inner annular portion 23*a* (or 21*a*) of the seal member 23 (or 21). In this modification, the inner annular portion 23*a* (or 21*a*) of the seal member 23 (or 21) defines an inner surface which is smoother than that in the first embodiment shown in FIG. 3 or 7. In the first embodiment, a sharp edge portion 23*a*-2 or 21*a*-2 is created along the inner surface of the annular portion 23*a* or 21*a* (See FIG. 3). The modification in FIG. 9 has no such sharp edge portion along the inner periphery, thereby preventing a stress concentration from being generated, and thereby increasing the strength.

Figure 10:
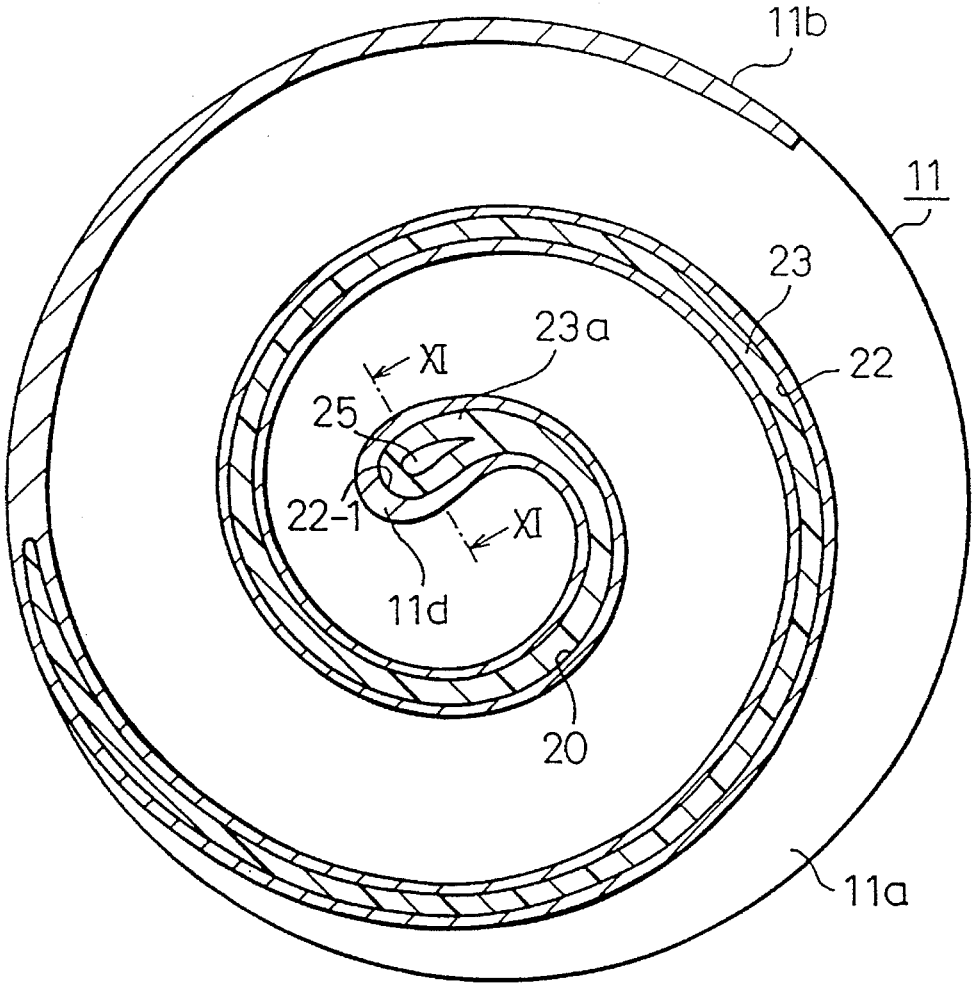
FIG. 10 is similar to FIG. 7 but illustrates another modification.
Figure 11:
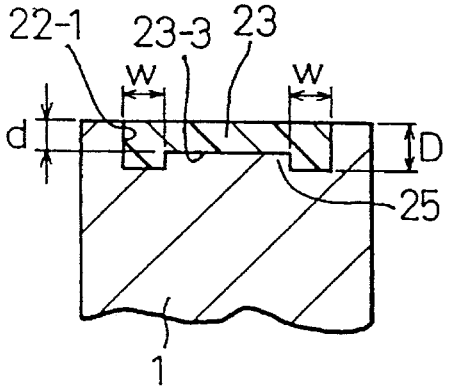
FIG. 11 is a cross-sectional view taken along line XI—XI in FIG. 10 after the groove is machined and a seal member is fitted.
Figure 12:
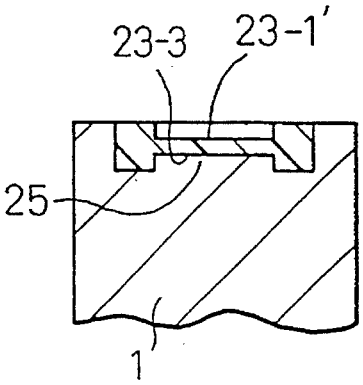
FIG. 12 is similar to FIG. 11 but illustrates a modification.
Figure 13:
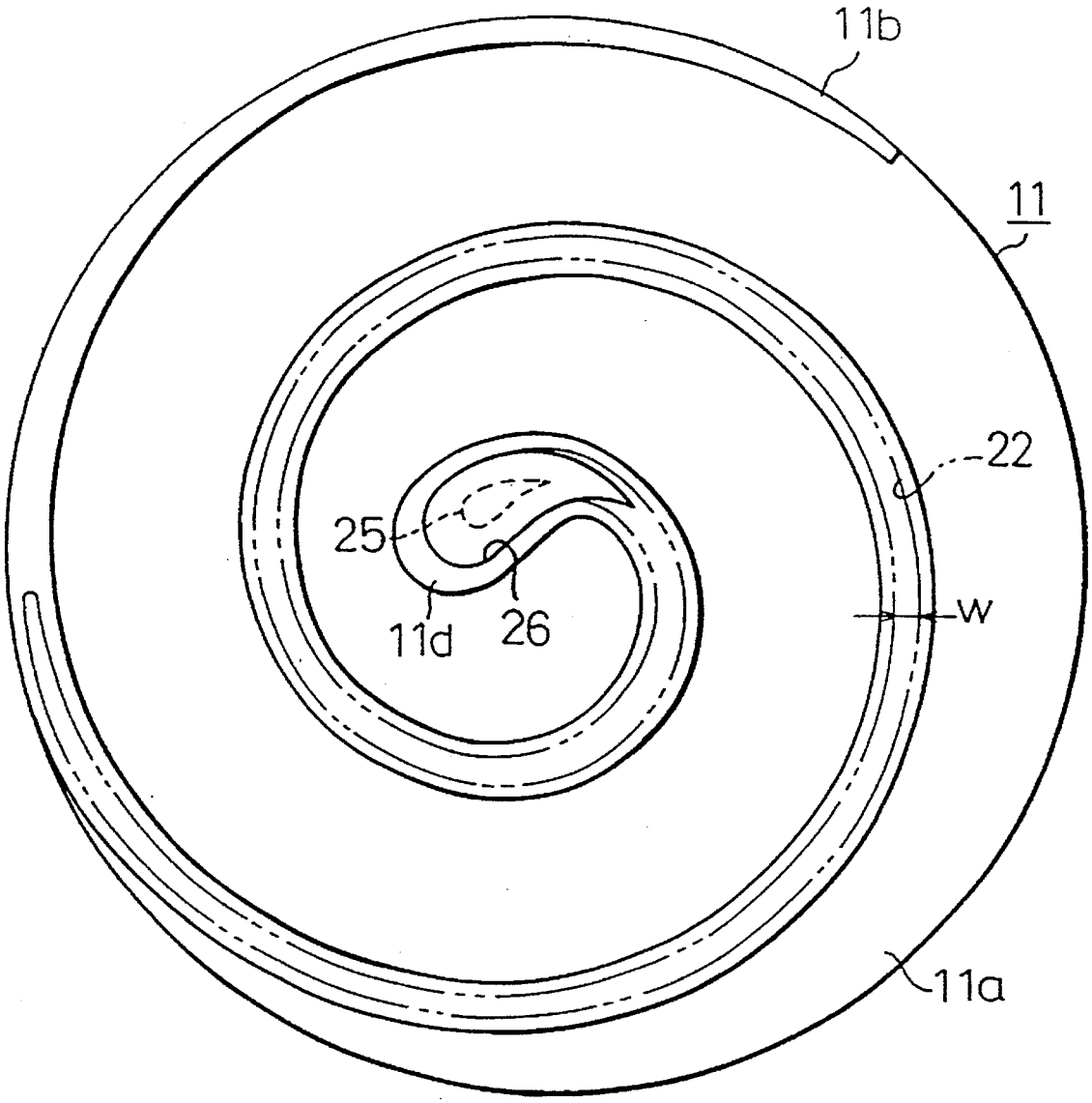
FIG. 13 is a plan view of a movable scroll member in the scroll compressor in FIG. 10 before it is machined.

FIGS. 10 and 11 show another embodiment, where the groove 22 (or 20) for the seal member 21 and 23 on the scroll wall 11*b* (or 1*b*) of the movable scroll member (or stationary scroll member) has, at its inner widened end 22-1 (or 20-1), a raised bottom portion 25 which is raised from the remaining parts of the bottom of the groove. The surface of the portion 25 is obtained when molding the member. Namely, the molding for obtaining the movable scroll member 11 (or the stationary scroll member 1) has a mold portion for creating a recess 26 of a depth d in FIG. 13 on the end surface of the scroll wall 11*b* (or 1*b*). Then, machining is done by using an end mill of a diameter corresponding to the width of the groove to be machined. The machining is done at a depth D which is greater than d, so that the groove 22 (or 21) is obtained. At the inner end 22-1 of the groove 22, the machining is done along the inner periphery by moving the end mill along a "looped" trajectory only once, so that the portion 25 of the depth d is left without being machined. As a result, similar to the previous embodiments, a machining operation for obtaining the groove 20 and 22 is simplified, thereby reducing the labor cost. The seal member 23 (or 21) has, at the inner end 23*a* (or 21*a*), a recess 23-3, which can be fitted to the projected portion 25. In a modification in FIG. 12, similar to the embodiment in FIG. 6, the seal member 23 (or 21) has, at its upper surface, a recess 23-1' for reducing the thickness of the seal member.

Figure 14:
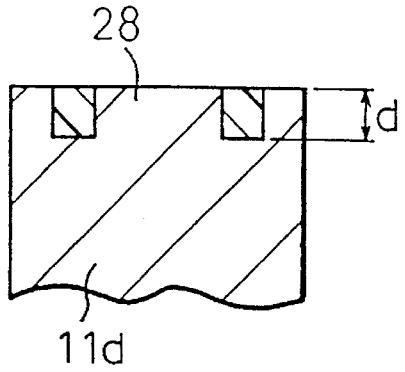
FIG. 14 is a cross-sectional view of an inner end of a scroll wall in another embodiment taken along line XIV—XIV in FIG. 15.
Figure 15:
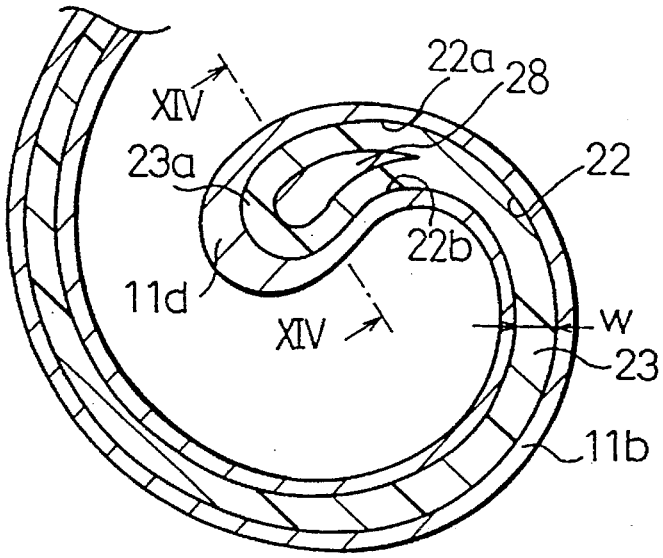
FIG. 15 is a partial plan view of the scroll member in FIG. 14.

In a modification shown in FIGS. 14 and 15, after the movable scroll member 11 or stationary scroll member 1 is molded, machining to a depth d is done so that the axial end surface of the scroll walls 11*b* and 1*b* is machined at the area of the width of W by using a milling tool of a diameter which is equal to the width W of the groove 22, so that the groove 22 (or 20) is created. At the widened portion 11*d* or 1*d*, the end mill is moved along a looped trajectory, so that the groove forms a looped portion having sections 22*a* and 22*b*, so that the portion 28 the molded member between the sections 22*a* and 22*b* is left without being machined. After the formation of the groove 22 or 20, the end surface of the scroll wall of the scroll member 11 and 1 is machined to prevent the molded surface from directly contacting the opposed surface. The sealing member 23 or 21 having looped end portion 23*a* is fitted to the groove 22. In this case, the machining by the milling tool is done only once, irrespective of the fact that the scroll wall has a widened inner portion 11*d* (or 1*d*), thereby increasing labor efficiency during the machining process.

Figure 16:
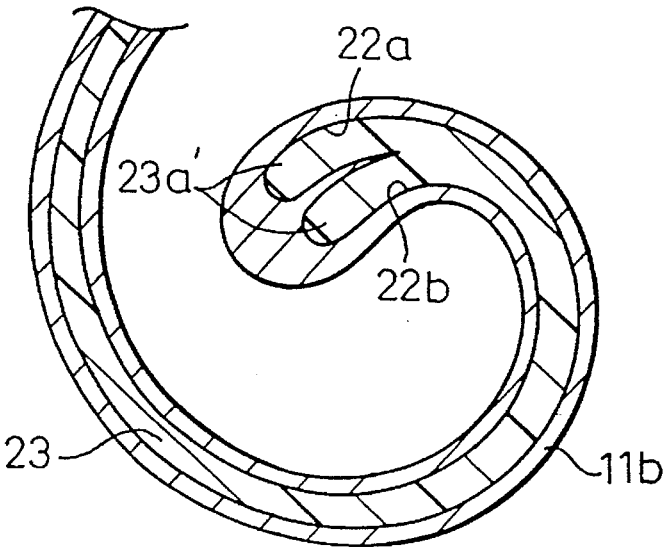
FIG. 16 is similar to FIG. 15, but illustrates another embodiment.

In a modification shown in FIG. 16, the sections 22*a* and 22*b* are separated at their inner ends. Thus, the seal member 23 or 21 has separated end sections 23*a*'.

Figure 17:
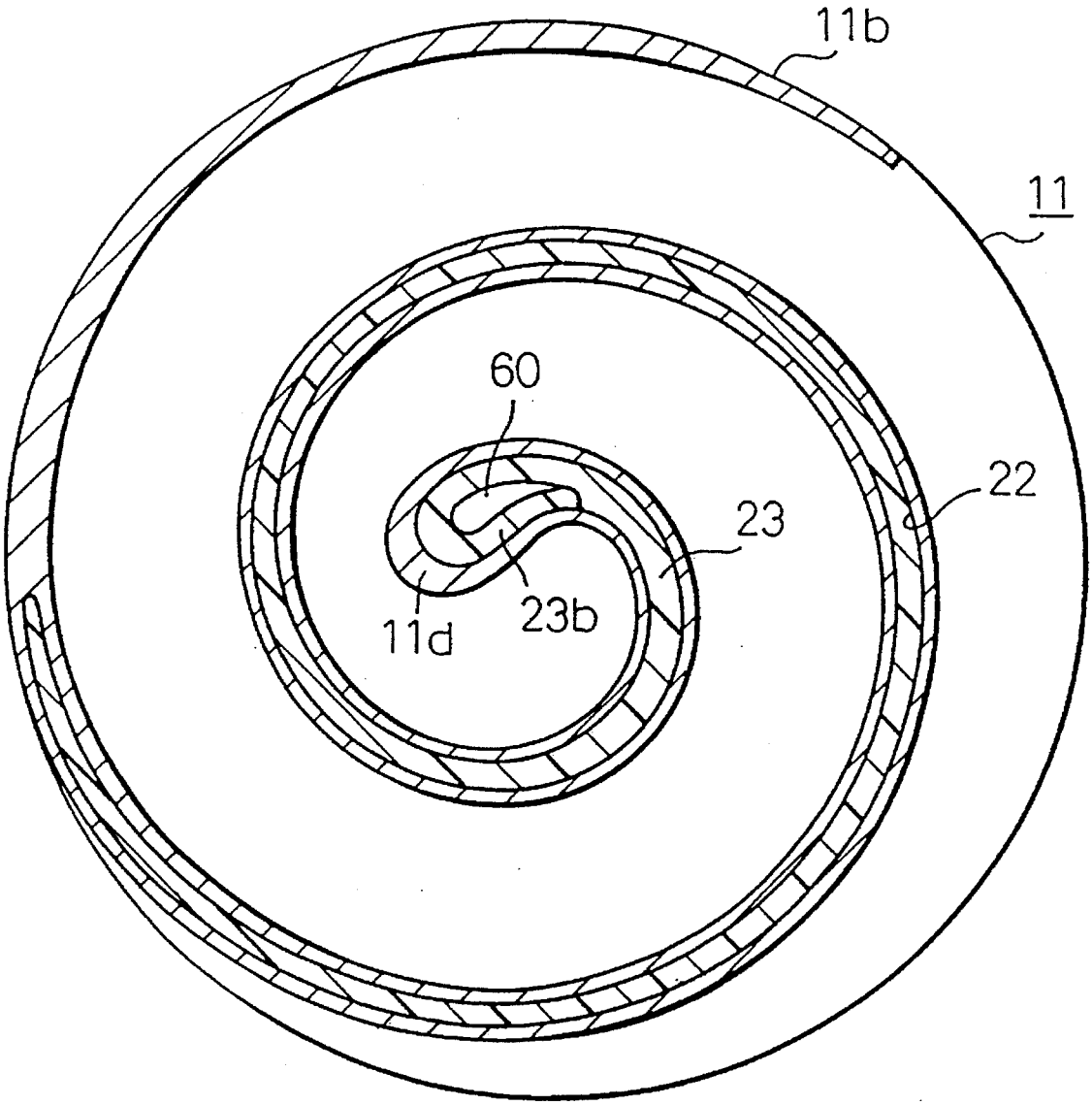
FIG. 17 is a plan view of the scroll member in still another embodiment.

FIG. 17 shows another embodiment, wherein, similar to the embodiment in FIG. 10 or 14, a projection 60 of a height the same as or smaller than the depth of the groove is left un-machined on the transverse surface of the scroll wall at the inner portion 11*d* thereof, when the groove 22 is cut by the machining tool by moving it along a looped trajectory. A seal member 23 made of a flexible plastic resin material is fitted to the groove, of which an inner end is fitted to the groove while looping the inner end 23*b* of the seal member 23 about the projection 60.

We claim:

1. A scroll compressor comprising:

a housing;

a drive shaft rotatably supported on the housing;

a stationary scroll member which is stationary in relation to the housing, the stationary scroll member having a base portion and a scroll wall extending axially from the base portion and having an axial end spaced therefrom;

a movable scroll member which is rotatably supported on the housing so that it is eccentric with respect to the stationary scroll member, the movable scroll member having a base portion and a scroll wall extending axially from the base portion and having an axial end spaced therefrom;

the scroll walls of the stationary and movable scroll members being in side-by-side contact with each other, while the axial end of the scroll wall of the stationary scroll member is in contact with the base portion of the movable scroll member and the axial end of the scroll wall of the movable scroll member is in contact with the base portion of the stationary scroll member so that radially spaced pump chambers are created between the stationary and movable scroll members;

said drive shaft being coupled with the movable scroll member so that when the drive shaft is rotated, an orbital movement of the movable scroll member is obtained about an axis of the drive shaft, so that the pump chambers translate radially inwardly while their volumes are simultaneously reduced;

an inlet port for introducing a fluid to be compressed into a pump chamber when it is located radially outwardly;

an outlet port for discharging the fluid as compressed from a pump chamber when it is located radially inwardly;

said scroll walls of the stationary and movable scroll members defining, at respective axial ends facing the opposite base portions, machined grooves extending along a spiral direction of the scroll members, the groove defining facing surfaces parallel to the axis of the drive shaft;

seal members fitted to the grooves of the stationary and movable scroll members, respectively;

said scroll walls of said stationary and movable scroll members having, at radially inward portions thereof, a section of greater width than the remaining parts of the scroll walls;

at said sections of greater width of each of the scroll walls, said grooves having an inner widened end where a spacing between said facing surfaces of the groove are greater than a spacing between said facing surfaces at the remaining portions of the groove at least one of said inner widened ends having a recess formed in a bottom portion thereof said recess having a depth larger than the depth of the remaining portion of the groove.

2. A scroll compressor according to claim 1, wherein, at a location corresponding to the recess, the seal member defines an annular portion to open the recess outwardly.

3. A scroll compressor according to claim 1, wherein, at a location corresponding to the recess, the seal member has a portion closing the recess, while the thickness of the seal member is partly reduced.

4. A scroll compressor comprising:

a housing;

a drive shaft rotatably supported on the housing;

a stationary scroll member which is stationary in relation to the housing, the stationary scroll member having a base portion and a scroll wall extending axially from the base portion and having an axial end spaced therefrom;

a movable scroll member which is rotatably supported on the housing so that it is eccentric with respect to the stationary scroll member, the movable scroll member having a base portion and a scroll wall extending axially from the base portion and having an axial end spaced therefrom;

the scroll walls of the stationary and movable scroll members being in side-by-side contact with each other, said axial end of said scroll wall of said stationary scroll member being in contact with said base portion of said movable scroll member and said axial end of said scroll wall of said movable scroll member being in contact with said base portion of said stationary scroll member so that radially spaced pump chambers are created between the stationary and movable scroll members;

said drive shaft being coupled with the movable scroll member so that when the drive shaft is rotated, an orbital movement of the movable scroll member is obtained about an axis of the shaft, so that the pump chambers translate radially inwardly while their volumes are simultaneously reduced;

an inlet port for introducing a fluid to be compressed into a pump chamber when it is located radially outwardly;

an outlet port for discharging the fluid as compressed from a pump chamber when it is located radially inwardly;

each of said scroll walls of the stationary and movable scroll members defining, at a respective axial end facing an opposite base portion, a groove extending along a spiral direction of the scroll member, the groove defining faced surfaces parallel to the axis of the shaft;

seal members fitted to the grooves of the stationary and movable scroll members, respectively;

said scroll walls of said stationary and movable scroll members having, at radially inward portions thereof, sections of greater width than the remaining parts of the scroll walls;

at said sections of greater width of each of the scroll walls, said grooves having an inner widened end where a spacing between said facing surfaces of the groove is greater than a spacing between said facing surfaces at the remaining portion of the groove, the groove having a recess spaced from said facing surfaces in a direction of the width of the groove, the recess having a depth larger than the depth of the remaining portion of the groove.

* * * * *